United States Patent [19]

Taub et al.

[11] Patent Number: 4,642,139

[45] Date of Patent: Feb. 10, 1987

[54] RAPIDLY SOLIDIFIED NICKEL ALUMINIDE OF IMPROVED STOICHIOMETRY AND DUCTILIZATION AND METHOD

[75] Inventors: Alan I. Taub, Schenectady; Shyh-Chin Huang, Latham; Keh-Minn Chang, Schenectady, all of N.Y.

[73] Assignee: General Electric Company, Schenectady, N.Y.

[21] Appl. No.: 646,877

[22] Filed: Sep. 4, 1984

[51] Int. Cl.[4] ..... C22F 1/10

[52] U.S. Cl. ..... 148/3; 148/429

[58] Field of Search ..... 148/429, 3; 420/460

[56] References Cited

PUBLICATIONS

C. T. Liu, C. L. White, C. C. Koch, & E. H. Lee, "Preparation of Ductile Nickel Aluminides for High Temperature Use", Proc. Electrochemical Soc. on High Temp. Mat., Ed. M. Cubicciotti, vol. 83-7, Electrochemical Society Inc. (1983), p. 32.

C. T. Liu & C. C. Koch, "Development of Ductile Polycrystalline $Ni_3Al$ for High-Temperature Applications", Technical Aspects of Critical Materials Use by the Steel Industry, NBSIR 83-2679-2, vol. II B, Jun. 1983, Center for Materials Science, U.S. Dept. of Commerce, National Bureau of Standards.

*Primary Examiner*—Richard O. Dean

*Attorney, Agent, or Firm*—Paul E. Rochford; James C. Davis, Jr.; Paul R. Webb, II

[57] ABSTRACT

It has been found that tri-nickel aluminide compositions are quite sensitive to the ratio of nickel to aluminum in their ability to receive boron as a dopant and that compositions which are relatively poor in the aluminum component can be doped more effectively with boron. Further, it has been found for the nickel aluminides which have lower concentrations of aluminum that the percentage of boron which can be added to the composition to effectively increase the strength of the alloys is favored by the lower aluminum ratio so that higher concentrations of boron are addable. The compositions which result have significant strength properties based on tensile tests of the compositions.

11 Claims, 2 Drawing Figures

RAPIDLY SOLIDIFIED NICKEL ALUMINIDE OF IMPROVED STOICHIOMETRY AND DUCTILIZATION AND METHOD

BACKGROUND OF THE INVENTION

The present invention relates generally to compositions having a nickel aluminide base and having a desirable stoichiometry which permits incorporation of greater quantities of ductilizing additives. More specifically, it relates to a rapidly solidified tri-nickel aluminide base alloy having improved ductilization based on boron doping and improved stoichiometry which enhances such doping.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and although potentially useful as a high temperature structural material, has not found extensive use in this application because of the poor properties of the materials at room temperature.

It is known that nickel aluminide has good physical properties at temperatures above 1000° F. and could be employed, for example, in jet engines as component parts for operating at higher temperatures. However, if the aluminide does not have favorable properties at room temperature and below, the part formed of this material may break when subjected to stress at the lower temperatures at which the part must be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses including tensile, thermal, vibratory and shock stresses, are encountered and where oxidation resistance is frequently required.

What has been sought in the field of superalloys is an alloy composition which displays favorable stress resistant properties not only at the elevated temperatures at which it may be used as, for example, in a jet engine but also a practical, desirable and useful set of properties at the lower temperatures to which the engine is subjected in storage and mounting and starting operations. For example, it is well known that an engine may be subjected to severe sub-freezing temperatures while standing on a field or runway prior to starting the engine.

Significant efforts have been made toward producing a tri-nickel aluminide and similar superalloys which may be useful over such a wide range of temperatures and which may be adapted to withstand stress to which the articles made from the material may be subjected in normal operations over a wide temperature range. For example, copending application Ser. No. 444,932, filed Nov. 29, 1982, now U.S. Pat. No. 4,478,791, and assigned to the same assignee as the subject application teaches a method by which a significant measure of ductility can be imparted to a rapidly solidified tri-nickel aluminide base metal at room temperature by addition of a small percentage of boron to overcome the brittleness of this material.

Also, copending application of the same inventors as the subject application, Ser. Nos. 647,327, 647,326, and 647,328, respectively, filed Sept. 24, 1984 teaches methods by which the composition and methods of the U.S. Pat. No. 4,478,791 may be further improved. These applications are incorporated herein by reference.

For the unmodified binary intermetallic, there are many reports in the literature of a strong dependence of strength and hardness on compositional deviations from stoichiometry. E. M. Grala in "Mechanical Properties of Intermetallic Compounds", Ed. J. H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. Met. Trans. 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuki also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p.32, discloses that the boron induced ductilization of the same alloy system is successful only for aluminum lean $Ni_3Al$.

The subject application presents a further improvement in the nickel aluminide to which significant increased ductilization has been imparted by boron doping.

BRIEF SUMMARY OF THE INVENTION

It is accordingly one object of the present invention to provide a method of forming a nickel aluminide of improved ductilization.

Another object is to provide a rapidly solidified nickel aluminide base alloy of improved ductility.

Another object is to provide a nickel aluminide alloy having high levels of boron doping.

Another object is to provide a nickel aluminide having a more predictable set of properties.

Other objects will be in part apparent and in part pointed out in the description which follows.

In one of its broader aspects, objects of the present invention may be achieved by providing a rapidly solidified nickel aluminide having a nickel to aluminum ratio which is relatively poor in aluminum, i.e. the ratio of nickel to aluminum is greater than 3:1 by some margin. The aluminum poor aluminide has been found to be dopable with greater concentrations of boron and to permit attainment of greater strength properties in the alloy.

BRIEF DESCRIPTION OF THE DRAWINGS

The invention will be made clearer by reference to the accompanying drawing in which.

DETAILED DESCRIPTION OF THE INVENTION

We have learned that the ratio of nickel to aluminum in a rapidly solidified tri-nickel aluminide alloy plays a strong role in the ability of the aluminide to receive boron as a dopant and of the boron to ductilize the tri-nickel aluminide alloy. A number of compositions containing different ratios of nickel to aluminum have been prepared particularly in the concentration range close to the stoichiometric 3 to 1 ratio in which the aluminum concentration x=0.25.

The stoichiometric ratio is considered only with respect to the nickel and aluminum components and not with respect to the boron or other ingredients. Thus, the stoichiometry is according to the formula $$(Ni_{1-x}Al_x)_yB_{100-y},$$

where x is the aluminum concentration in the range 0.225 to 0.26, and where y is approximately 97 to 99.75.

Figure 1:
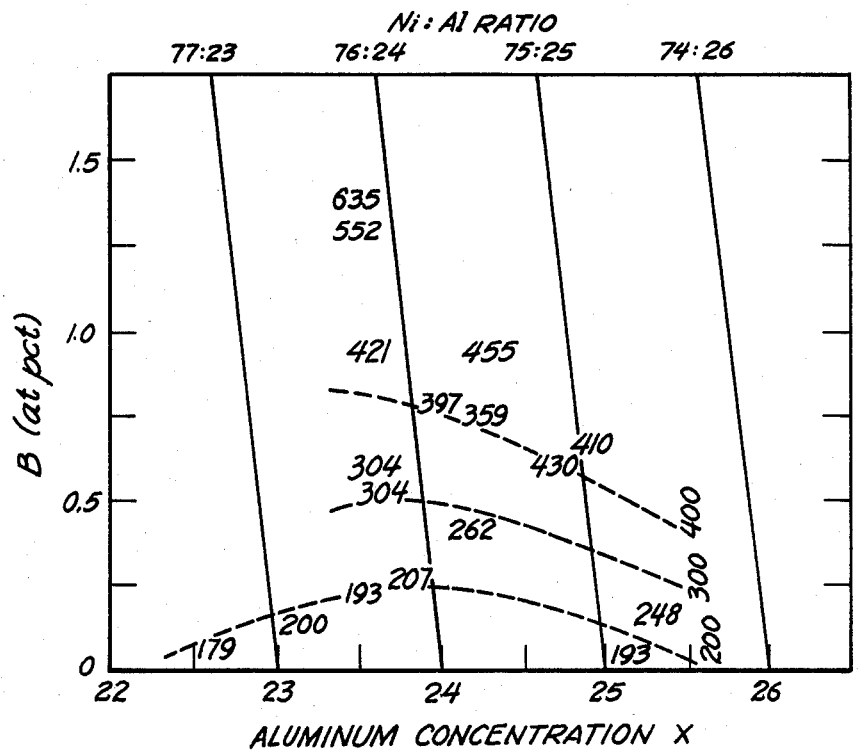
FIG. 1 is a graph of the atomic percent boron in nickel aluminide of the composition $(Ni_{1-x}Al_x)_yB_{100-y}$, plotted as the ordinate, against the aluminum, concentration x plotted as the abscissa. The nickel aluminum ratio is plotted as the abscissa at the top of the figure. Tensile strength of the rapidly solidified nickel aluminide annealed at 1100° C. for 2 hours are listed on the figure at locations which identify the concentrations of nickel, aluminum and also of boron serving as a dopant for the nickel aluminide. The solid lines of the figure indicate constant nickel to aluminum ratios.

Referring now first to FIG. 1, an array of ratios of nickel to aluminum is plotted in solid lines, the significance of which are identified at the top of the figure. The first ratio line on the left represents the ratio of 77 parts nickel to 23 parts aluminum, or 77/23. At the bottom scale of the figure the atomic percent of aluminum is given as x=0.23 at the lower end of the first ratio line.

The point at which the lower abscissa intersects the left ordinate represents x=0.22 of aluminum.

On the left ordinate, the concentration of boron added to the composition is given in atomic percent starting with 0 atomic percent at the abscissa level and proceeding to 0.5, 1.0 and 1.5 atomic percent boron as labeled.

In this figure, tensile yield strength of the rapidly solidified $Ni_3Al$ doped with boron ($Ni_3Al$-B) as a function of the aluminum concentration and of the boron concentration are plotted. Each tensile value displayed on the FIG. 1 is located at the position corresponding to a boron dopant concentration and also to a specific ratio of nickel to aluminum.

The tensile offset yield strength values displayed are the 0.2 offset yield strength plotted in MPa. For example, at a boron concentration of 0.25%, a 0.2 offset yield strength of 207 MPa was found for a sample having a nickel to aluminum ratio of 76:24. Similarly, at a boron concentration of approximately 0.5, a 0.2 offset yield strength of 304 MPa was found for the composition having the nickel to aluminum ratio of 76:24.

The dashed lines of the figure are constant strength contours based on inferences drawn from the data plotted and recorded on the figure.

It is evident from FIG. 1, and it is made particularly evident from consideration of the constant strength contour lines that a desirable set of tensile properties is found from the inclusion of the boron dopant in compositions which are relatively close to but below the 3 to 1 stoichiometric ratio of the nickel to aluminum. The first two dashed lines of the figure indicate that a minimum yield strength for a given percentage of boron occurs at a nickel to aluminum ratio of 76:24 or at about an aluminum concentration x=0.24.

Also, it is evident from the tensile values displayed on the FIG. 1 plot that the 0.2 offset yield strength in MPa increases with boron content along the line representing the ratio of nickel to aluminum of 76:24. Thus the lowest tensile value (0.2 offset yield strength) along this 76:24 ratio axis is 207 MPa at about 0.25 atomic percent boron. The tensile value at about 0.5% boron concentration is 304 MPa. The 0.2 offset yield strength in MPa at about 0.8 to 0.9 atomic percent boron is 421. At the 1.25 atomic percent boron level, a yield strength of 552 is found and at a slightly higher atomic percent boron level the yield strength figure listed is 635. This data demonstrates that the tensile properties improve with increase in boron concentration.

Figure 2:
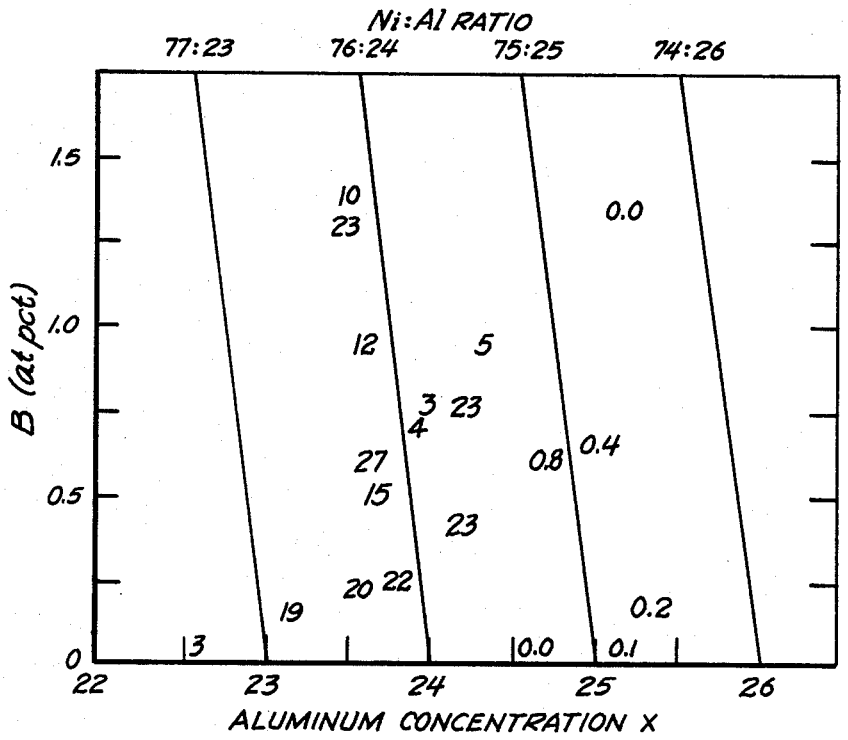
FIG. 2 is a graph similar to that of FIG. 1 but displaying values of plastic strain to failure in percent on a set of coordinates as described with reference to FIG. 1.

With reference now to FIG. 2, the data obtained from the preparation of a number of sample compositions from the spin casting of these compositions by the rapid solidification process and from changes in the ratio of nickel to aluminum of the various compositions as well as changes in the atomic percent boron in the various compositions, there is found an array of data as to physical properties of the various compositions. In this particular figure, plastic strain to failure in percent is listed on the figure at the respective ratio of nickel to aluminum and atomic percent boron concentration. It is evident that some of the highest values found for the plastic strain to failure lie in the region of the nickel to aluminum ratio represented by the line for the ratio 76:24.

For example, at an essentially zero concentration of boron for concentration of aluminum of about x=0.226, the value of ductility given is 3. Also, the ductility value found for the same minimal level of concentration of boron but at a nickel to aluminum ratio of 75:25, ductility is 0.1. The ductility value at x=0.245 aluminum is 0.0. Ductility values as given here and as displayed in FIG. 2 are values in % of plastic strain to failure. These values are also referred to as values of strain to failure after yield as set forth in copending application Ser. No. 444,932 references above.

By contrast, the ductility figures for the relatively low percent of boron at approximately x=0.24 aluminum are very significant and in the order of 20 and 22 and 23 percent. Further, from following the ratio line for 75 nickel and 25 aluminum, it is evident that relatively low values of strain to failure are found at boron concentrations of 0.65 and that these values are at the order of 0.4 and 0.8. At essentially the same concentration level of boron, with the ratio of nickel to aluminum represented by the ratio line for the 76:24 ratio and at a 0.5% boron concentration, the ductility values of the strain to failure percentage are 15 and 27. At slightly higher atomic percentages of boron, lower values of percentage plastic strain to failure are found of the order of 4, 3 and 23. However, the data extending over the length of the line representing the ratio of nickel to aluminum of 76:24 is persuasive that the plastic strain to failure for concentrations having a nickel to aluminum ratio of approximately 76:24 are substantial and are approximately 10 and 23 at a boron concentration of 1.35% and 1.25%, respectively.

It will be understood that the data plotted on FIG. 2 is to a large degree the measure of plastic strain to failure for the same samples which are shown in FIG. 1 in terms of the 0.2 offset yield strength in MPa.

The test data displayed on the graph of FIG. 2 can be compared directly with the test data concerning ductility which appears in copending application Ser. No. 444,932 referenced above. In that application, the ductility values were given for the as-cast alloy having a nominal nickel:aluminum ratio of 75:25. The ductility values reached a maximum at a boron concentration of about 1.0 atomic percent and decreased at higher boron concentrations. From the above data of this application, the ductility values of those alloys after annealing can be seen to be low for all boron levels to 1.5%. As is evident from the data displayed in FIG. 2, much greater ductility values of annealed specimens have been found for boron concentrations of 0.25 to about 1.5% in alloy systems in which the ratio of nickel to aluminum is approximately 76:24.

Based on the above data, it is our conclusion that on a comparative basis, the aluminum poor alloys, meaning the alloys having a lower percentage of aluminum than is prescribed by the stoichiometric ratio of 3:1 or 75:25 can be ductilized effectively by means of boron addition and boron doping. Further, it is believed evident from the data of the examples and of the figures that boron can be put into the alloy with greater effectiveness for the compositions which have the lower aluminum content where the boron is put in solid solution through rapid solidification and that the alloy which results has greater ductility based on doping of the alloy having the lower ratio of aluminum.

What is claimed and sought to be protected by Letters Patent of the United States is as follows:

1. A nickel aluminide composition having an improved combination of tensile and ductility properties which comprises a rapidly solidified, annealed nickel aluminide according to the expression $$(Ni_{1-x}Al_x)_yB_{100-y},$$

said aluminide having an aluminum concentration x between 0.235 and 0.245, and having a relatively high percentage content of boron 100−y between 0.5 and 1.5, and said composition being rapidly solidified from a melt at a rate greater than about $10^{3°}$ C. per second and having a $L1_2$ type crystal structure.

2. The composition of claim 1 in which the aluminum concentration x is approximately 0.24.

3. The composition of claim 1 in which the aluminum concentration x is approximately 0.24 and the boron concentration 100−y is between 1.0 and 1.5.

4. The composition of claim 3 in which the boron concentration, 100−y, is about 1.5.

5. As an article of manufacture a ribbon article said ribbon being composed predominantly of a trinickel aluminide of the composition $$(Ni_{1-x}Al_x)_yB_{100-y}$$

wherein x is between 0.235 and 0.245 and 100−y is between 0.5 and 1.5 and said ribbon being rapidly solidified and having a $L1_2$ type crystal structure.

6. The ribbon of claim 5 wherein the aluminum concentration x is about 0.24.

7. The ribbon of claim 5 wherein the aluminum concentration is about 0.24 and the boron concentration 100−y is between 1.0 and 1.5.

8. The ribbon of claim 5 wherein the boron concentration 100−y is about 1.0.

9. The method of forming a nickel aluminide of high strength which comprises preparing a melt having a composition of the formula $$(Ni_{1-x}Al_x)_yB_{100-y}$$

wherein x is between 0.235 and 0.245, and

100−y is between 0.5 and 1.5 rapidly solidifying the melt to form a $L1_2$ crystal structure, and annealing the rapidly solidified melt to form a strong product.

10. The method of claim 9 in which x is between 0.235 and 0.245 and 100−y is between 1.0 and 1.5.

11. The method of claim 9 in which x is approximately 24.

* * * * *